US008833283B2

(12) United States Patent
Ferrarotti et al.

(10) Patent No.: US 8,833,283 B2
(45) Date of Patent: Sep. 16, 2014

(54) INKJET PRINTHEAD, IN PARTICULAR FOR SEWING/EMBROIDERING MACHINES, A METHOD FOR MAKING SAID INKJET PRINTHEAD, AND A METHOD FOR COLORING A THREAD

(75) Inventors: Rinaldo Ferrarotti, Arnad (IT); Alberto Albertin, Arnad (IT)

(73) Assignee: Sicpa Holding SA, Prilly (CH)

( * ) Notice: Subject to any disclaimer, the term of this patent is extended or adjusted under 35 U.S.C. 154(b) by 542 days.

(21) Appl. No.: 13/141,433

(22) PCT Filed: Dec. 30, 2008

(86) PCT No.: PCT/IT2008/000811

§ 371 (c)(1),
(2), (4) Date: Jun. 22, 2011

(87) PCT Pub. No.: WO2010/076823

PCT Pub. Date: Jul. 8, 2010

(65) Prior Publication Data

US 2011/0254896 A1 Oct. 20, 2011

(51) Int. Cl.

| | |
|---|---|
| ***B65H 59/00*** | (2006.01) |
| ***B41J 3/44*** | (2006.01) |
| ***D06P 5/30*** | (2006.01) |
| ***D05C 11/24*** | (2006.01) |
| ***B41J 3/407*** | (2006.01) |

(52) U.S. Cl.

CPC . *B41J 3/445* (2013.01); *D06P 5/30* (2013.01); *D05C 11/24* (2013.01); *B41J 3/4078* (2013.01); *B41J 3/407* (2013.01)

USPC ..... 112/270

(58) Field of Classification Search

USPC ..... 700/136–138; 112/136, 270, 278, 112/470.01

See application file for complete search history.

(56) References Cited

U.S. PATENT DOCUMENTS

| | | | | |
|---|---|---|---|---|
| 4,465,005 | A * | 8/1984 | Eguchi et al. | 112/270 |
| 4,554,179 | A | 11/1985 | Roderburg | |
| 4,875,348 | A * | 10/1989 | Kinnebrew et al. | 112/270 |
| 4,886,515 | A * | 12/1989 | Kinnebrew et al. | 112/270 |
| 6,189,989 | B1 * | 2/2001 | Hirabayashi et al. | 347/4 |
| 2009/0241819 | A1 * | 10/2009 | Tseng | 112/470.05 |

FOREIGN PATENT DOCUMENTS

| | | |
|---|---|---|
| GB | 2 142 280 | 1/1985 |

* cited by examiner

*Primary Examiner* — Nathan Durham

(74) *Attorney, Agent, or Firm* — Greenblum & Bernstein, P.L.C.

(57) ABSTRACT

An inkjet printhead, in particular for sewing/embroidering machines, includes a support structure; a plurality of firing cells included in the support structure, each firing cell being adapted to eject ink through a respective nozzle for coloring a thread to be used in a sewing/embroidering machine; a guide element, provided on the support structure, for guiding the thread in a position facing said nozzles. Also disclosed are a sewing/embroidering machine including the printhead and a method for making the printhead.

20 Claims, 3 Drawing Sheets

FIG 2
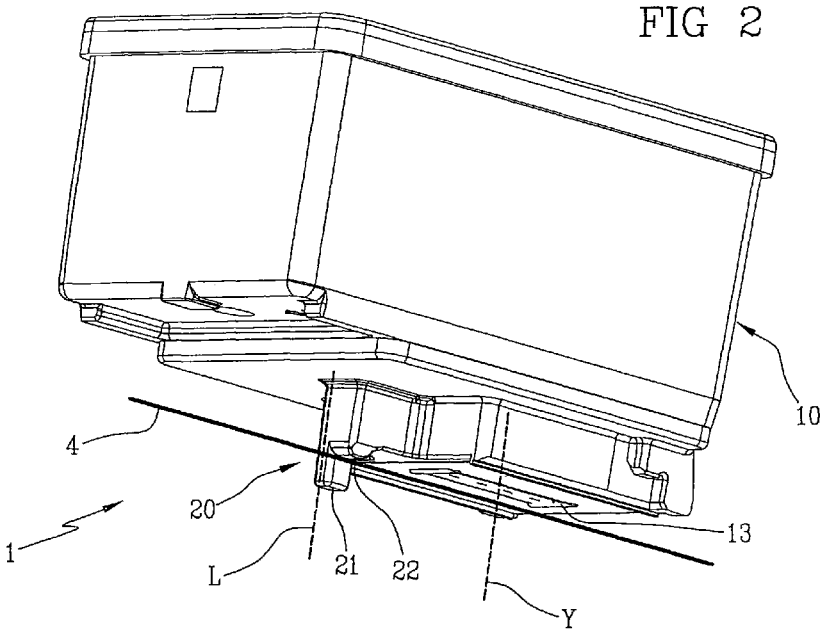
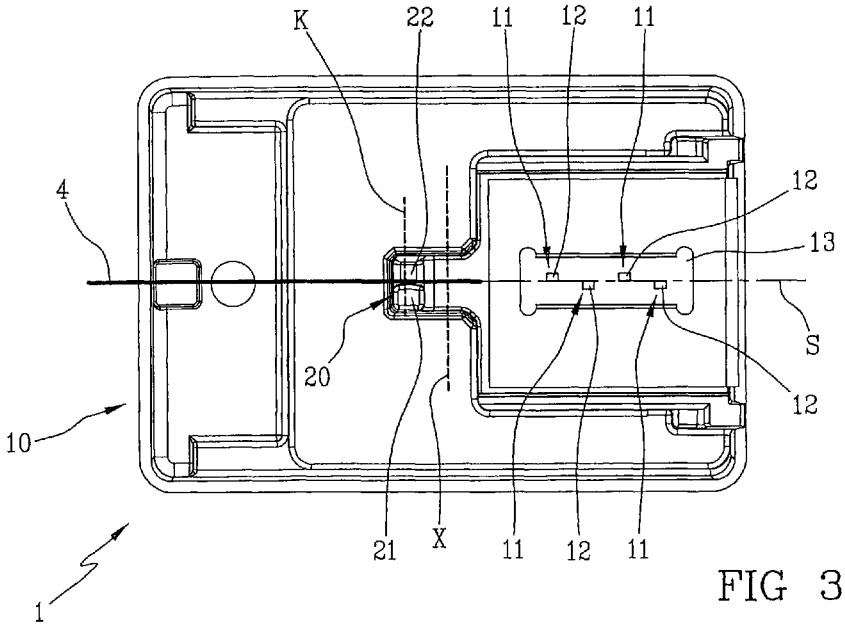
FIG 3

FIG 4
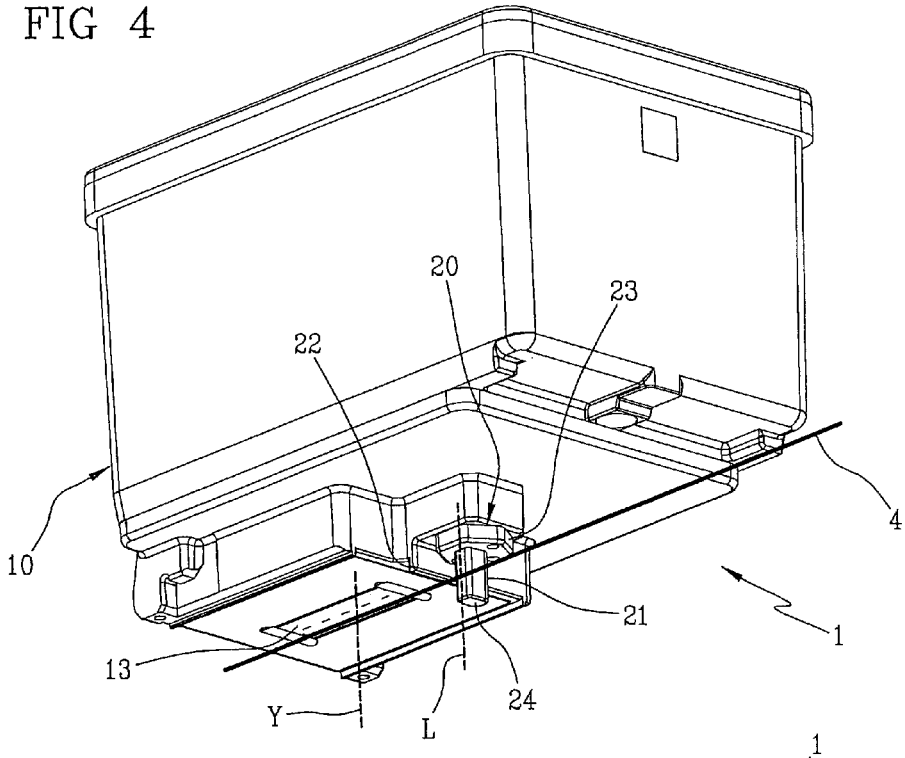
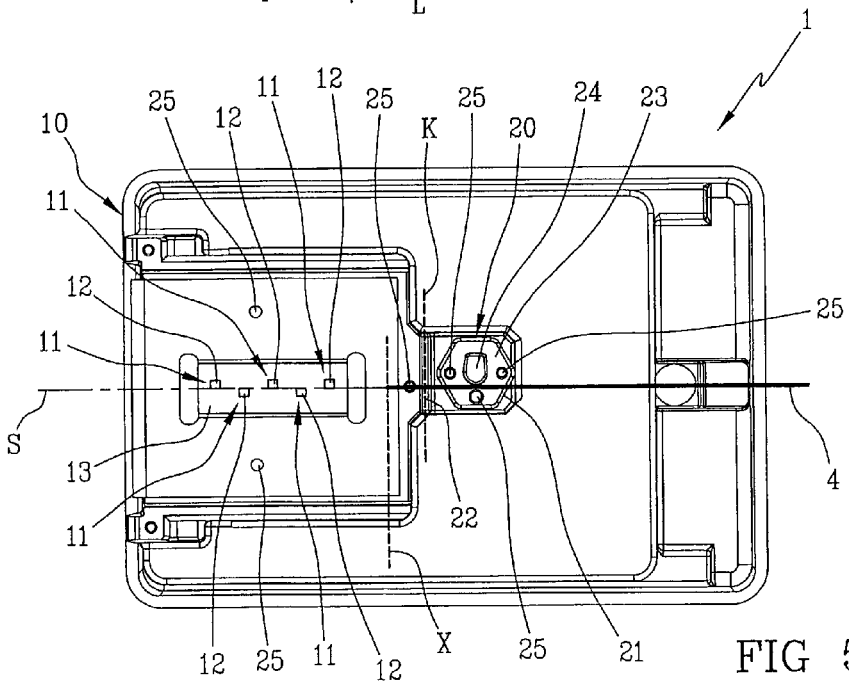
FIG 5

INKJET PRINTHEAD, IN PARTICULAR FOR SEWING/EMBROIDERING MACHINES, A METHOD FOR MAKING SAID INKJET PRINTHEAD, AND A METHOD FOR COLORING A THREAD

The present invention relates to an inkjet printhead for sewing/embroidering machines.

The present invention also relates to a sewing/embroidering machine provided with an inkjet printhead for coloring a thread before the same thread is used for sewing and/or embroidering.

The present invention also relates to a method for making an inkjet printhead for use in a sewing/embroidering machine.

As it is known, the state of the art comprises sewing/embroidering machines provided with an inkjet printhead for coloring a thread before the same thread is used for sewing and/or embroidering.

In more detail, such machines include a bobbin around which a thread is wound; a printing station to which the thread is provided and wherein, the thread is colored through an inkjet printhead; a drying station, wherein the colored thread is heated and dried, so that such thread is suitable for being used for sewing or embroidering a predetermined product, such as for example a textile product; an operative station, wherein said product is properly positioned and sewed and/or embroidered with said thread.

Document U.S. Pat. No. 6,189,989 discloses an ink jet printing apparatus having a station for dyeing a thread for embroidering by discharging ink onto the thread from an ink jet head. A printing controller controls the amount of ink discharged per unit of time onto the thread according to the speed of the relative movement of the thread and the ink jet head. Also, it is taken into account the length of non-usable thread per unit time between an ink jet printing unit and the tip of an embroidery needle in an embroidery machine.

A drawback shown in the machines according to the state of the art regards the imprecise alignment of the thread with respect to the ejecting nozzles.

In fact, after being unwound from the above mentioned bobbin, the thread is generally guided by a first pulley, mounted between the bobbin and the printing station.

Then, after being colored and dried, the thread is guided by a second pulley, which feeds the sewing/embroidering members.

In other words, the relative position between the thread and the nozzles is defined by the cited first and second pulleys.

The applicant noted that, in case the distance between the first and second pulley is about 30 cm, even a minimum error or tolerance in the position of the pulleys with respect to the printhead (and in particular with respect to the nozzles) prevents the thread from being precisely placed in front of the nozzles.

Moreover, unavoidable tolerances in the assembling of the printhead, in the position of the printhead on the machine and of the active members which bring the printhead in the printing position, contribute to the misalignment of the thread with respect to the nozzles.

Such imprecise mutual positioning causes a non uniform and inhomogeneous coloring of the thread, and a decrease of the quality of the final product obtained after sewing or embroidering.

By way of example, the tolerance in the positioning of the first pulley with respect to the frame of the machine is about ±1 mm; the tolerance in the position of the nozzles on the printhead is about ±0.05 mm; the tolerance in the positioning of the printhead with respect to the carriage support is about ±0.1 mm; the tolerance in the positioning of the carriage support with respect to the frame of the machine is about ±0.25 mm; the tolerance in the positioning of the second pulley with respect to the frame of the machine is about ±1 mm.

Therefore, in the worst case, the misalignment of the thread with respect to the nozzles is of about ±1.4 mm.

The applicant found a possible solution: an additional guide element is mounted on the carriage which supports the printhead and with respect to which the printhead is regularly moved during its functioning.

In this solution, the maximum misalignment between the thread and the nozzles is reduced, but it is still unacceptable.

In fact, taking into account that: ±0.25 mm is the tolerance between the frame of the machine and the support carriage; ±0.1 mm is the tolerance between the support carriage and the printhead mounted thereon; ±0.05 mm is the tolerance between the printhead and the nozzles; ±0.05 mm is the tolerance between the printhead and the guide element mounted on the support carriage; ±1 mm is the tolerance between the second pulley and the machine frame, the following result is obtained, in case the distance between the first and second pulley is 25 cm, the distance between the first pulley and the first nozzle is 10 cm, and the distance between the first nozzle and the last nozzle is 11 cm:

$$\frac{(0.25 + 0.1 + 0.05) + 1}{250} \cdot (10 + 11) = \pm 0.12 \text{ mm}$$

and the maximum misalignment is substantially equal to:

$$0.05+0.05+0.12=\pm 0.22 \text{ mm}$$

Another possible solution would be to increase the number of inkjet units and/or the number of nozzles, so that a larger ejecting area is obtained and the likelihood of provision of ink to the thread is correspondingly increased.

However, such solutions show unacceptable drawbacks, such as, for example, the increase of the number of components to be used (two printheads instead of a single one); the large amount of ink that is wasted, since only a small portion of the ejected ink is actually received by the thread; the increase of energetic consumption, since a higher number of firing cells have to be activated for increasing the amount of ink ejected.

The Applicant has noted that, by using an additional guide element, the position of the thread with respect to the ejecting nozzles can be defined in a very precise way, thereby solving the aforementioned problem and overcoming the cited drawbacks.

More particularly, the guide element is provided on the printhead, so as to be at least partly substantially integral with the same printhead. Likewise, irrespective of the position of the first and second pulleys, the thread is properly guided in a position facing the ejecting nozzles.

According to a first aspect, the invention regards an inkjet printhead, in particular for sewing/embroidering machines, comprising:

- a support structure;
- a plurality of firing cells included in said support structure, each firing cell being adapted to eject ink through a respective nozzle for coloring a thread to be used in a sewing/embroidering machine;
- a guide element, provided on said support structure, for guiding said thread in a position facing said nozzles.

Preferably, the guide element defines the position of the thread in a first direction, substantially parallel to a plate-like element in which the nozzles are made and substantially perpendicular to a thread alignment direction, and in a second direction, substantially perpendicular to said plate-like element.

Likewise, both alignment with the nozzles and distance therefrom are defined by means of said guide element.

According to another aspect, the invention regards a machine for sewing and/or embroidering comprising:

a feeding member for providing at least a thread;

a printing station adapted to receive said thread and to color the same;

a drying station, wherein the colored thread provided by the printing station is dried;

an operative station, wherein said thread is used for sewing and/or embroidering a predetermined product wherein said printing station comprises the aforementioned inkjet printhead.

According to another aspect, the invention regards a method for making an inkjet printhead for use in a sewing/embroidering machine, said method comprising:

providing a support structure including a plurality of firing cells, each firing cell being adapted to eject ink through a respective nozzle for coloring a thread to be used in a sewing/embroidering machine;

providing a guide element on said support structure, for guiding said thread in a position facing said nozzles.

Preferably, the method further comprises the following steps:

mounting said guide element on said support structure in an initial position, said guide element being movable on said support structure in two or more positions, each corresponding to a respective position of said thread when said printhead is in use;

defining a target position of said guide element with respect to said nozzles;

detecting a current position of said guide element;

detecting a position of said nozzles;

comparing the position of said guide element with the position of said nozzles;

moving said guide element depending on said comparison in order to arrange said guide element in said target position.

When the guide element is in its target position, the same guide element is fixed to the support structure. With reference to the above cited example, in case the additional guide element is co-moulded with the support structure of the printhead, the maximum misalignment between the thread and the nozzles will be determined by the following contributions:

±0.05 mm which is the tolerance between the printhead and the nozzles;

±0.02 mm which is the tolerance between the printhead and the guide element;

±1 mm which is the tolerance between the second pulley and the machine frame.

Therefore $$(1/250)\cdot(7+11)=\pm 0.07 \text{ mm}$$

and the maximum misalignment is substantially equal to $$0.05+0.01+0.07=\pm 0.13 \text{ mm}$$

In case the additional guide element is regulated before being fixed to the structure of the printhead, the maximum misalignment is limited to $$(1/250)\cdot(7+11)=\pm 0.07 \text{ mm}$$

thereby obtaining a significant improvement in the alignment between the thread and the nozzles.

According to a still further aspect, the invention regards a method of coloring a thread to be used in a sewing/embroidering machine, comprising:

providing a thread to a printing station included in a sewing/embroidering machine, said printing station being provided with an inkjet printhead comprising a support structure including a plurality of nozzles;

guiding said thread in a position facing said nozzles through a guide element provided on said support structure;

ejecting ink trough said nozzles for coloring said thread.

Further features and advantages will become more apparent from the detailed description of a preferred, but not exclusive, embodiment of the present invention. This description will be set out hereinafter with reference to the accompanying drawings, given by way of non-limiting example, in which:

FIG. 2 shows a schematic perspective view of a first embodiment of the printhead according to the present invention;

FIG. 3 shows a schematic bottom view of the printhead of FIG. 2;

FIG. 4 shows a schematic perspective view of a second embodiment of the printhead according to the present invention;

FIG. 5 shows a schematic bottom view of the printhead of FIG. 4.

Figure 1:
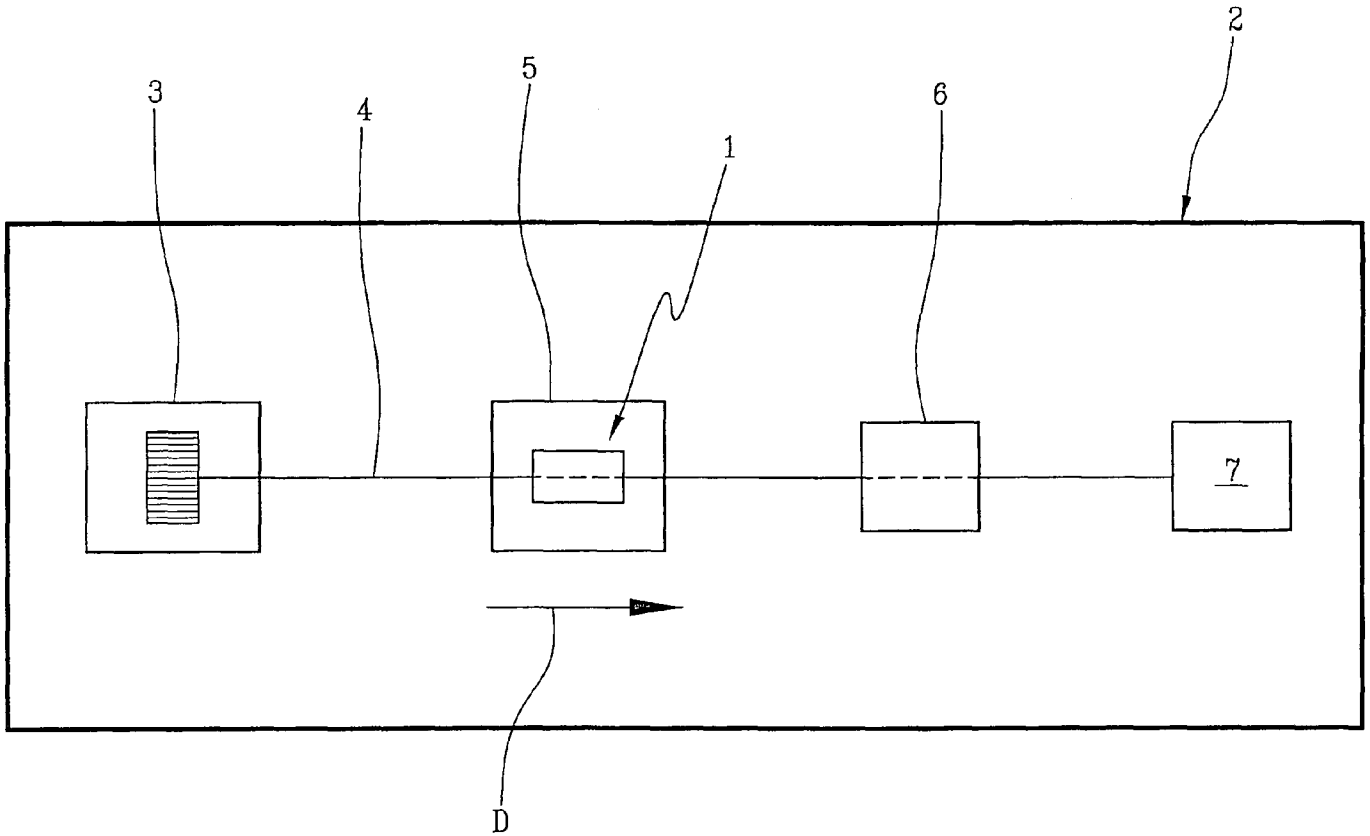
FIG. 1 is a schematic block diagram of a machine for sewing/embroidering in which the printhead according to the present invention is used.

With reference to the drawings, the inkjet printhead according to the present invention is generally denoted at 1.

Inkjet printhead 1 is included in a sewing/embroidering machine 2.

As schematically shown in FIG. 1, the machine 2 includes a feeding member 3, which is adapted to provide a thread 4 to the other members included in the machine 2.

For example, the feeding member 3 can be realized as a bobbin, around which a thread 4 is wound.

The thread is, for example, a polyester thread, although other textile materials are also possible for the thread.

The feeding member 3 feeds the thread 4 to a printing station 5, where the printhead 1 is located. The printhead 1 ejects ink onto the thread 4, so as to color the same.

The machine 2 further comprises a drying station 6, wherein the colored thread is dried, preferably by heating, so that the same thread is suitable for being used for sewing or embroidering a predetermined product, such as for example a textile product.

The machine 2 further comprises an operative station 7, wherein said product is properly positioned and sewed and/or embroidered with said thread 4.

Thus, the thread 4 has an advancing direction D that is preferably defined by the succession of feeding member 3, printing station 5, drying station 6 and operative station 7.

In more detail, the printhead 1 (FIGS. 2-5) comprises a support structure 10, which can be in the form of a substantially parallelepiped box structure. The support structure 10 includes a plurality of firing cells 11; each firing cell 11 is adapted to eject ink through a respective nozzle 12 for coloring the thread 4.

Preferably, the nozzles 12 are made in a plate-like element 13, integral with the support structure 10; in particular, the nozzles 12 are through-holes made in said plate-like element 13.

Each firing cell 11 is hydraulically connected to an ink reservoir, for receiving ink to be ejected.

Each firing cell 11 is also provided with a respective resistor which, when properly heated through a suitable current, causes formation of a bubble and ejection of an ink droplet.

Preferably the printhead 1 further comprises a control circuit (not shown) for selectively activating the firing cells 11; in particular, the control circuit generates firing current commands for heating the resistors of the firing cells 11.

Advantageously, the printhead 1 further comprises a guide element 20, provided on said support structure 10, for guiding the thread 4 in a position facing the aforementioned nozzles 12.

The guide element 20 defines the position of the thread 4 with respect to the nozzles 12.

In particular, the guide element 20 defines the position of the thread 4 along a first direction X, which is substantially parallel to the plate-like element 13 and substantially perpendicular to the thread alignment direction, and along a second direction Y which is transverse, and preferably substantially perpendicular, with respect to said plate-like element 13.

As schematically shown in FIGS. 2-5, the guide element 20 comprises a first portion 21 for defining the position of the thread 4 in the first direction X, and a second portion 22 for defining the position of the thread 4 in the second direction Y.

Preferably the first portion 21 has a main longitudinal direction L that is transverse, and in particular perpendicular, with respect to the plate-like element 13.

Preferably, the second portion 22 has a main longitudinal direction K that is substantially parallel to the plate-like element 13 and preferably substantially perpendicular to the thread alignment direction.

For example, the second portion 22 of the guide element 20 defines a distance of the thread 4 from the nozzles 12 which can be comprised between 0.5 mm and 1.5 mm.

Preferably, the guide element 20 is provided on the support structure 10 so as to precede the nozzles 12 according to the advancing direction D of the thread 4.

In other words, the thread 4 fed by the feeding member 3 is guided by the guide element 20 before the same thread 4 faces the nozzles 12.

Accordingly, the guide element 4 can properly define the position of the thread 4 with respect to the nozzles 12.

Preferably, the nozzles 12 are arranged on the plate-like element 13 so that such arrangement has a symmetry axis S.

Preferably, the symmetry axis S defines the path along which the thread 4 should be aligned.

Preferably, the first portion 21 of the guide element 20 is not symmetrically arranged with respect to the symmetry axis S of the nozzles 12.

Likewise, a part of the external surface of the first portion 21 is substantially aligned (or substantially tangent) to the symmetry axis S so that the thread 4, being guided by such part of the external surface of the first portion 21, can be properly arranged along said symmetry axis S.

Such position of the thread 4 with respect to the nozzles 12 allows a precise and efficient coloring of the same thread 4.

Preferably the guide element 20 is at least partly integral with the support structure 10; in particular, the guide element 20 can be completely integral with the support structure 10.

Preferably the guide element 20 is integral with the plate-like element 13.

FIGS. 2-3 schematically shows a first embodiment of the guide element 20.

In the first embodiment, the guide element 20 is completely integral with the support structure 10; preferably the support structure 10 and the guide element 20 are co-moulded.

In the first embodiment, the guide element 20 is preferably "L" shaped.

The vertical portion of the "L" shape constitutes the first portion 21 of the guide element 20, i.e. the portion that defines the position of the thread 4 in a direction X parallel to the plate-like element 13. Preferably the first portion 21 is perpendicular to the plate-like element 13.

The horizontal portion of the "L" shape constitutes the second portion 22, that defines the position of the thread according to a direction Y perpendicular to the plate-like element 13.

Preferably the second portion 22 is parallel to the plate-like element 13.

The second portion 22 can constitute a shim to define a proper distance between the nozzles 12 and the thread 4.

Preferably, in the first embodiment, the support structure 10 and the guide element 20 are made of the same material, such as for example Polyphenylene Oxide (PPO), Polysulfone (PSU), Polyethylene terephthalate (PET), Polyethylene terephthalate blended with Polybutylene terephthalate (PET+PBT), etc.

FIG. 4-5 schematically shows a second embodiment of the guide element 20.

In the second embodiment, the first portion 21 of the guide element 20 comprises a plate-like base 23, and a pin 24 eccentrically mounted on the base 23 and integral with the same.

Preferably, the plate-like base 23 has a substantially hexagonal perimeter.

In the second embodiment, the first portion 21 is preferably made in a material different than the support structure 10.

The support structure 10 can be made, for example, of Polyphenylene Oxide (PPO), Polysulfone (PSU), Polyethylene terephthalate (PET), Polyethylene terephthalate blended with Polybutylene terephthalate (PET+PBT), etc.

The first portion 21 of the guide element 20 can be made, for example, of Polyphenylene Oxide (PPO) blended with Glass Fibers (PPO+GF), Polyethylene terephthalate blended with Polybutylene terephthalate and Glass Fibers (PET+PBT+GF), etc.

The first portion 21 can be fixed to the support structure 10 by ultrasound welding, for example, or through an adhesive substance, suitably interposed between the first portion 21 and the support structure 10.

It is to be noted that, using two different materials for the support structure 10 and the first portion 21 of the guide, element 20 can allow achievement of advantages in terms of resistance to wear due to the action of the thread during its sliding on the same guide element 20.

In fact, the material of which the support structure is made has primarily to resist to contact with ink, which can have erosive properties.

If a different material is used for the guide element 20, major concern may be dedicated to resistance to the action of the sliding thread.

Furthermore, if the first portion 21 is not ultrasound welded to the support structure 10, more possibilities are available in the choice of the material of the first portion 21, since no constraint is present as to compatibility with ultrasound welding.

In the second embodiment, the second portion 22 can be realized as a shim, mounted on or fixed to the support structure 10, on the same side of the first portion 21 with respect to the nozzles 12. In particular, the shim can be interposed between the nozzles 12 and the first portion 21 of the guide element 20.

As mentioned above, the invention also relates to a method for making the inkjet printhead 1.

In general, such method comprises the following steps:

providing the support structure 10;

mounting the firing cells 11 on the support structure 10;

mounting the guide element 20 on the support structure 10, for guiding the thread 4 in a position facing the nozzles 12.

In particular, with reference to the second embodiment of the guide element 20, the support structure 10 and the first portion 21 of the guide element 20 are initially separated.

Then the method preferably comprises a step of mounting the first portion 21 of the guide element 20 on the support structure 10 in an initial position.

In other words, a projecting portion of the first portion 21, which extends on the opposite side of the plate-like base 23 with respect to the pin 24, is inserted in a seat of the support structure 10.

Thus, the first portion 21 of the guide element 20 is movable on the support structure 10 in a number of different positions, since the first portion 21 can be rotated around the axis defined by the longitudinal extension of the pin 24 and projecting portion.

It is to be noted that since the pin 24 is eccentrically positioned on the plate-like base 23, each position of the first portion 21 on the support structure 10 corresponds to a respective position of the thread 4 with respect to the nozzles 12 when the machine is in use.

A target position is determined for said guide element 20, which corresponds to an arrangement of a thread which is substantially aligned with the symmetry axis S of the nozzles 12.

In other words, it is desirable that the thread be positioned along the symmetry axis S of the nozzles 12, so that it can be properly and efficiently colored.

Then, through an optical system, the current position of the guide element 20 with respect to the nozzles 12 is determined.

If the guide element 20 is properly positioned, so that a hypothetical thread is arranged along the symmetry axis S of the nozzle arrangement, i.e. if the guide element 20 is in the target position, the position of the first portion 21 of the guide element 20 is correct, and it needs only to be fixed to the support structure 10.

If the guide element 20 is not properly positioned, so that the hypothetical thread guided by said guide element 20 is not aligned with the symmetry axis S of the nozzle arrangement, i.e. if the guide element 20 is not in the target position, the first portion 21 of the guide element 20 is moved, in order to change correspondingly the position of the guide element 20 and cause the same to reach the target position.

Preferably the aforementioned optical system is connected to an electronic unit, which processes the data provided by the optical system and compares the current position of the guide element with the target position.

Preferably the electronic unit is adapted to drive, according to said comparison, an electromechanical actuator which moves the first portion 21 of the guide element 20, so that the same guide element 20 can reach the target position.

In practice, the electromechanical actuator comprises an operative tool which is adapted to engage the hexagonal perimeter of the plate-like base 23, in order to rotate the first portion 21 in a proper position.

Advantageously, the support structure 10 and the plate-like base 23 are provided with marking portions 25, such as for example marking cavities, in order to let the optical system define their position and properly changing the position of the first portion 21 if necessary.

Preferably, since the guide element 20 is provided, the maximum misalignment between the thread 4 and the nozzles 20 is less than ±0.13 mm, and more preferably less than ±0.07 mm.

After the guide element 20, and in particular the first portion 21 is arranged in a position such that the guide element 20 is in its target position, the same first portion 21 is fixed to the support structure 10.

The fixing step can be carried out through an adhesive substance (such as, for example, epoxy resin (Ecobond E3200, DELO VE43309, DELO monopox), acrylate resin, etc.; in particular, the adhesive substance can be interposed between the plate-like base 23 and the support structure 10. The adhesive substance can also fill in partly the seat before the projecting portion is inserted therein.

The adhesive substance allows changes of the first portion 21 for a few seconds, then it fixes the same first portion 21 to the support structure 10.

As an alternative, ultrasound welding can be employed to fix the first portion 21 to the support structure 10.

It is to be noted that, in both embodiments, the first portion 21 of guide element 20 engages the thread 4 on one side only, i.e. for example the downwardly directed side in FIG. 3 or the upwardly directed side in FIG. 5), in order to let the printhead 1 move without removing the thread 4 from the machine 2.

In fact, the printhead 1 needs to be moved away from its working position when it has to be replaced, when at the end of the day it has to be positioned in an anti-evaporating non-working position.

The invention claimed is:

1. An inkjet printhead usable on a sewing/embroidering machine, said printhead comprising:

a support structure;

a plurality of firing cells arranged on said support structure, each firing cell being adapted to eject ink through a respective nozzle for coloring a thread;

a guide element arranged on said support structure and being configured to guide said thread in a position facing said nozzles; and said guide element being configured to allow movement of the printhead relative to the thread and having at least one of:

an open side lower side; and an open lateral side.

2. The printhead of claim 1, wherein said support structure comprises a plate-like element, said guide element defining the position of said thread along a first direction parallel to said plate-like element and perpendicular to a thread alignment direction, and a second direction transverse to said plate-like element.

3. The printhead of claim 2, wherein said guide element comprises a first portion for defining the position of said thread in said first direction, and a second portion for defining the position of said thread in said second direction.

4. The printhead of claim 1, wherein said guide element is at least partly integral with said support structure.

5. The printhead of claim 1, wherein the nozzles of the firing cells are symmetrically arranged relative to a symmetry axis which substantially defines a direction along which said thread is moved in front of said nozzles.

6. The printhead of claim 5, wherein a first portion of said guide element is not symmetrically arranged with respect to said symmetry axis when the printhead is in use.

7. The printhead of claim 6, wherein said first portion comprises: a plate-like base and a pin eccentrically mounted on and integral with said plate-like base.

8. The printhead of claim 7, wherein at least said first portion is made of a material that is different from that of said support structure.

9. The printhead of claim 1, wherein said guide element is completely integral with at least a part of said support structure.

10. The printhead of claim 1, wherein said guide element is substantially L-shaped.

11. The printhead of claim 1, wherein said guide element is located on said support structure so as to precede said nozzles relative to a moving direction of said thread.

12. A method for making an inkjet printhead for use in a sewing/embroidering machine, said method comprising:

arranging a plurality of firing cells on a support structure, each firing cell being adapted to eject ink through a respective nozzle for coloring a thread to be used in a sewing/embroidering machine;

arranging a guide element on said support structure, wherein said guide element has at least one of an open side lower side and an open lateral side and is configured to:

guide said thread in a position facing said nozzles; and allow movement of the printhead relative to the thread.

13. A method of coloring a thread of a sewing/embroidering machine, the method comprising:

moving a thread to a printing station of a sewing/embroidering machine;

coloring said thread via an inkjet printhead of said printing station comprising a support structure having a plurality of nozzles configured to eject ink onto said thread; and guiding said thread in a position facing said nozzles via a guide element arranged on said support structure, wherein said guide element has at least one of an open side lower side and an open lateral side.

14. An inkjet printhead, in particular for sewing/embroidering machines, comprising:

a support structure;

a plurality of firing cells included in said support structure, each firing cell being adapted to eject ink through a respective nozzle for coloring a thread to be used in a sewing/embroidering machine;

a guide element, provided on said support structure, for guiding said thread in a position facing said nozzles; and said guide element comprising a first portion having a plate-like base; a pin eccentrically mounted on said plate-like base and integral with the plate-like base.

15. The printhead of claim 14, wherein at least said first portion is made of a material different than said support structure.

16. An inkjet printhead, in particular for sewing/embroidering machines, comprising:

a support structure;

a plurality of firing cells included in said support structure, each firing cell being adapted to eject ink through a respective nozzle for coloring a thread to be used in a sewing/embroidering machine;

an L-shaped guide element, provided on said support structure, for guiding said thread in a position facing said nozzles;

said l-shaped guide element being completely integral with at least a part of said support structure.

17. A method for making an inkjet printhead for use in a sewing/embroidering machine, said method comprising:

providing a support structure including a plurality of firing cells, each firing cell being adapted to eject ink through a respective nozzle for coloring a thread to be used in a sewing/embroidering machine;

providing a guide element on said support structure, for guiding said thread in a position facing said nozzles;

mounting said guide element on said support structure in an initial position, said guide element being movable on said support structure in two or more positions, each corresponding to a respective position of said thread when said printhead is in use;

defining a target position of said guide element with respect to said nozzles;

detecting a current position of said guide element;

detecting a position of said nozzles;

comparing the position of said guide element with the position of said nozzles; and moving said guide element depending on said comparison in order to arrange said guide element in said target position.

18. The method of claim 17 further comprising:

verifying that said guide element is substantially in said target position; and fixing said guide element to said support structure.

19. The method of claim 17, wherein said guide element comprises at least a first portion for determining the position of said tread in a first direction parallel to a plate-like element in which said nozzles are made, said first portion being eccentrically rotatable with respect to said support structure, and wherein said moving said guide element comprises eccentrically rotating said first portion of said guide element.

20. The method of claim 19, wherein said first portion has a rotation axis substantially perpendicular to said plate-like element.

* * * * *